United States Patent [19]

Nygards

[11] 4,258,758

[45] Mar. 31, 1981

[54] AUTOMATIC LIQUID-CONTAINER FILLER

[76] Inventor: Nils Nygards, 7435 Highway 65 Northeast, Minneapolis, Minn. 55432

[21] Appl. No.: 71,696

[22] Filed: Aug. 31, 1979

Related U.S. Application Data

[63] Continuation of Ser. No. 913,590, Jun. 8, 1978, abandoned.

[51] Int. Cl.[3] ..... B65B 3/26

[52] U.S. Cl. ..... 141/35; 137/571; 141/198

[58] Field of Search ..... 4/206, 207, 424; 137/571, 256, 260, 261; 141/35, 198, 230, 234, 247, 324, 367, 392; 222/136

[56] References Cited

U.S. PATENT DOCUMENTS 719,846 2/1903 Neubert et al. ..... 222/136

2,884,021 4/1959 Ginsburg ..... 141/35

*Primary Examiner*—Frederick R. Schmidt

*Attorney, Agent, or Firm*—Schroeder, Siegfried, Ryan, Vidas, Steffey & Arrett

[57] ABSTRACT

A simple device for automatically filling a plurality of open containers, such as bottles, to permit a plurality of such containers to be sequentially filled, when connected to a constant source of liquid, without possibility of running over. A common header receiving the liquid has a plurality of depending traps, each connected thereto with an inlet tube which is shorter than the distance the traps outlet tube extends into the container, whereby the entrance of the liquid is automatically cut off when the liquid level in the container rises sufficiently to cover the lower end of the outlet tube and the hydrostatic pressure thereat equals that of the inlet tube.

9 Claims, 2 Drawing Figures

AUTOMATIC LIQUID-CONTAINER FILLER

Figures 1, 2:
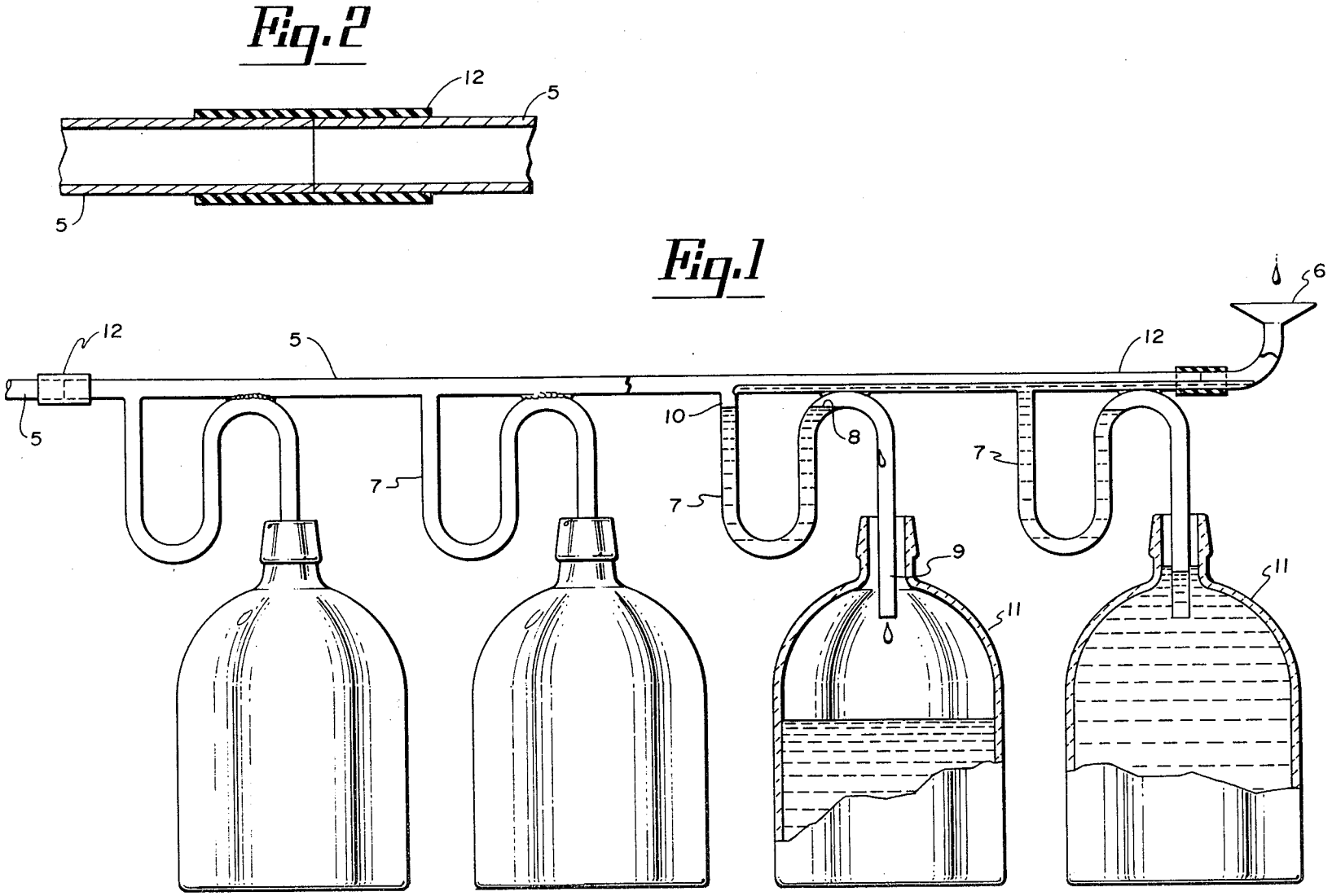

This is a continuation of application Ser. No. 913,590, filed June 8, 1978, now abandoned.

It is the general object of my invention to provide a simple and inexpensive but highly effective automatic liquid-container filler which is inexpensive to manufacture and simple to utilize.

A more specific object is to provide a simple device which can be utilized in conjunction with a constant source of liquid to automatically fill a plurality of open containers with the liquid without filling any to excess, thereby enabling the device to remain unattended over an extended period of time.

These and other objects and advantages of my invention will more fully appear from the following description, made in connection with the accompanying drawings, wherein like reference characters refer to the same or similar parts throughout the several views, in which FIG. 1 is a side elevational view of an automatic liquid-container filler positioned with respect to a plurality of open-necked bottles and illustrating the manner in which it functions; and FIG. 2 is an enlarged fragmentary vertical sectional view taken through the coupling shown at the lefthand side of FIG. 1 and illustrating the manner in which the device may be extended to permit filling of an unlimited number of such open-necked containers.

The device is comprised of a simple, elongated header conduit 5 which is adapted to receive a liquid from a constant source (not shown), such as a distiller, through the use of a funnel member 6. The header member 5 carries a plurality of depending trap members 7 within which the liquid is trapped until it reaches its upper liquid-trapping level indicated by the numeral 8. Thereafter, the liquid flows over into the outlet tube 9, which is connected to the trap above the level 8, and depends therefrom to a level substantially lower than the trap, as shown in FIG. 1. The trap is connected to the header by an inlet tube 10 which is defined as that portion of the tube which extends from the header 5 to the trap member at the upper liquid-trapping level. Each of the traps 7 is an upwardly facing U-shaped conduit and is constructed identically and is secured, as shown, to the underside of the header 5 in liquid receiving relation.

When the liquid is received in the header, as illustrated at the righthand side of FIG. 1, it passes along the header, which is preferably downwardly inclined to the left, as shown in FIG. 1, until it reaches the first trap 7 which is filled first. When the trap is filled, the liquid commences to overflow into the outlet tube 9 and to fill the container 11. When the level of the liquid in the container 11 rises sufficiently so as to cover the lower end of the outlet tube 9, the air within the tube 9 is trapped therein and the liquid continues to pass into the container until the hydrostatic pressure at the outlet of the tube 9 equals the hydrostatic pressure which is built up within the inlet tube 10. Thereafter, no more liquid will flow into the container 11 and it will continue to pass to the left, as viewed in FIG. 1, to the next trap 7, at which location the process just described is repeated until the container is filled. Thus, each of the containers will be filled sequentially without any of them running over, and despite being open, or unsealed.

It will be readily appreciated, that if it is desired, an unlimited number of containers 11 may be connected to the header 5 by merely extending the latter as shown through the use of a simple coupling 12, which may be connected to another header 5 with similar traps 7, and outlet tubes 9.

It will be readily appreciated that through the use of a such a device, as is shown herein, it is possible to operate a system which provides a constant source of liquid, such as a water distiller, and leave the same unattended for extended periods of time without concern about the collector containers 11 becoming overfilled and running over.

It will be recognized that the tubular material from which the trap 7 is constructed is of equal diameter to that of the inlet tubes 10 and the outlet tubes 9. It is critical that the outlet tube 9 be of sufficient length and extend into the container a sufficient distance so that the hydrostatic pressure which is built up at the lower end of the outlet tube when the liquid level rises thereabove becomes equal to that which is created at the inlet tube 10 when the liquid ceases to pass through the trap 7. When this occurs, the trap is by-passed and the liquid continues on to the next trap and container.

It will, of course, be understood that various changes may be made in the form, details, arrangement and proportions of the parts without departing from the scope of my invention which consists of the matter shown and described herein and set forth in the appended claims.

I claim:

1. An automatic liquid-container filler for sequentially and automatically filling a plurality of open containers having their openings below the filler, comprising:

(a) a generally horizontally extending elongated header conduit adapted to receive liquid therein for free flow conveyance to a plurality of containers;

(b) a plurality of non-valved liquid drain-trap members carried by said conduit and each having an upper liquid-trapping level disposed below said header conduit and above the container openings;

(c) a plurality of inlet tubes spaced longitudinally of said header conduit and connected thereto in liquid-receiving relation at locations spaced longitudinally thereof;

(d) one each of said inlet tubes being connected to one of said drain-trap members for conveying liquid from said header conduit to its associated drain-trap member in free-flowing relation; and (e) a plurality of filler tubes, one each of which is connected to one of said drain-trap members in liquid-receiving relation at an elevation above said upper liquid-trapping level and extending downwardly therefrom to a level sufficiently far therebelow to enable a hydrostatic pressure to be developed therewithin equal to that created in its associated inlet tube when said filler tube is inserted into an open container and the latter is filled sufficiently to cover the lower end of said filler tube.

2. The structure defined in claim 1 wherein said inlet tubes have a length approximating the diameter of their associated filler tube.

3. The structure defined in claim 1 wherein each of said inlet tubes is relatively short as compared to the vertical depth of its associated drain trap.

4. The structure defined in claim 1 wherein said filler tubes are affixed to the underside of said header conduit.

5. The structure defined in claim 1 and a plurality of open containers, one each of which is disposed directly below one of said filler tubes in liquid-receiving relation and has a liquid confining upper lip disposed a vertical distance above the lower end of its associated filler tube in excess of the length of its associated inlet tube.

6. The structure defined in claim 1 wherein the length of each of said filler tubes exceeds the length of its associated inlet tube.

7. The structure defined in claim 1 wherein the length of at least some of said filler tubes substantially exceeds the length of their associated inlet tubes.

8. The structure defined in claim 1 wherein the length of each of said filler tubes is substantially greater than the length of its associated inlet tube.

9. The structure defined in claim 1 wherein at least one of said drain-trap members is comprised of an upwardly facing U-shaped conduit.

* * * * *